US006009963A

United States Patent [19]

Chaves et al.

[11] Patent Number: 6,009,963

[45] Date of Patent: Jan. 4, 2000

[54] SUPERABRASIVE CUTTING ELEMENT WITH ENHANCED STIFFNESS, THERMAL CONDUCTIVITY AND CUTTING EFFICIENCY

[75] Inventors: Arthur A. Chaves, Sandy, Utah; David M. Schnell, The Woodlands, Tex.; Craig H. Cooley, Bountiful, Utah; David M. Johnson, Westerville, Ohio; Eoin M. O'Tighearnaigh, Dublin, Ireland; Luther L. White, Columbus, Ohio

[73] Assignee: Baker Hughes Incorporated, Houston, Tex.

[21] Appl. No.: 08/783,171

[22] Filed: Jan. 14, 1997

[51] Int. Cl.[7] ..... E21B 10/46

[52] U.S. Cl. ..... 175/432; 175/434

[58] Field of Search ..... 175/432, 430, 175/431, 434, 428

[56] References Cited

U.S. PATENT DOCUMENTS

| | | | |
|---|---|---|---|
| 3,902,864 | 9/1975 | Nix et al. . | |
| 4,452,325 | 6/1984 | Radd et al. . | |
| 4,629,373 | 12/1986 | Hall | 428/408 |
| 4,705,123 | 11/1987 | Dennis | 175/428 |
| 4,726,718 | 2/1988 | Meskin et al. . | |
| 4,898,252 | 2/1990 | Barr . | |
| 4,928,777 | 5/1990 | Shirley-Fisher . | |
| 4,972,637 | 11/1990 | Dyer | 51/295 |
| 5,030,276 | 7/1991 | Sung et al. . | |
| 5,096,465 | 3/1992 | Chen et al. . | |
| 5,120,327 | 6/1992 | Dennis . | |
| 5,199,832 | 4/1993 | Meskin et al. . | |
| 5,205,684 | 4/1993 | Meskin et al. . | |
| 5,238,074 | 8/1993 | Tibbitts et al. . | |
| 5,355,969 | 10/1994 | Hardy et al. | 175/432 |
| 5,435,403 | 7/1995 | Tibbitts | 175/432 |
| 5,460,233 | 10/1995 | Meany et al. | 175/428 |
| 5,590,729 | 1/1997 | Cooley et al. | 175/432 |
| 5,622,233 | 4/1997 | Griffin | 175/432 |
| 5,669,271 | 9/1997 | Griffin et al. | 175/428 X |
| 5,711,702 | 1/1998 | Delvin | 175/432 X |
| 5,740,874 | 4/1998 | Matthias | 175/430 |

FOREIGN PATENT DOCUMENTS

| | | |
|---|---|---|
| 0 032 428 A1 | 8/1981 | European Pat. Off. . |
| 0 246 789 A2 | 11/1987 | European Pat. Off. . |
| 2 044 146 | 10/1980 | United Kingdom . |
| WO 97/04209 | 2/1997 | WIPO . |

OTHER PUBLICATIONS

Mellor, Malcolm, *Mechanics of Cutting and Boring, Part IV: Dynamics and Energetics of Parallel Motion Tools,* CRREL Report 77–7, Apr. 1977, pp. 72–77.

*Primary Examiner*—Hoang Dang
*Attorney, Agent, or Firm*—Trask, Britt & Rossa

[57] ABSTRACT

A cutter for use on a rotary-type drag bit for earth boring is provided comprising a substantially rectangular diamond table attached to and supported by a substrate. A plurality of rod-like diamond pilings made of polycrystalline diamond is carried in the substrate, extending from the cutting face of the diamond table, through the diamond table, and into the substrate material. The diamond pilings are generally arranged in a mutually parallel configuration substantially transverse to the plane of the diamond table, and the forward ends of each diamond piling may coextensively terminate at the cutting face of the diamond table, may terminate within the diamond table, or may merely abut the rear of the diamond table. Further, the diamond table may be of smaller size than the transverse cross-section of the substrate, and at least a portion of the periphery of the substrate may then be forwardly and inwardly tapered to provide structural support to the diamond table.

49 Claims, 4 Drawing Sheets

SUPERABRASIVE CUTTING ELEMENT WITH ENHANCED STIFFNESS, THERMAL CONDUCTIVITY AND CUTTING EFFICIENCY

BACKGROUND OF THE INVENTION

1. Field of the Invention

The present invention relates to subterranean earth boring drill bits and, more particularly, to superabrasive cutters or cutting elements for use primarily on drill bits of the rotary drag type.

2. State of the Art

Rotary drag-type drill bits are comprised of a bit body mounted to a shank for connection to a drill string and having an inner channel or plenum communicating with the shank for supplying drilling fluid to the face of the bit. The bit body carries a plurality of cutting elements. Each cutting element may be mounted directly on the bit body or on a carrier, such as a stud or post, that is received in a socket in the bit body, typically on the bit face and sometimes on the gage.

When industrial quality natural and synthetic diamonds were first used on rotary drag bits, they were typically embedded into a metal substrate of a cutting element or as freestanding cutters in the metal matrix of a bit body. The diamonds had to be substantially embedded so that the mechanical nature of their attachment to the bit would withstand the high and diversely-oriented forces experienced during the drilling process, thus limiting the exposure of the diamonds to cut the formation.

Later, advances in the commercial production of synthetic diamonds made it possible to process diamond particles into larger disc shapes. The discs, or diamond tables, were typically formed of a particulate combination of sintered polycrystalline diamond and cobalt carbide. These diamond tables were formed during high-temperature, high-pressure fabrication and simultaneously bonded to a cemented tungsten carbide substrate, producing a cutter having a substantially planar cutting face. These cutters, generally termed "PDC's," for polycrystalline diamond compacts, are affixed to the bit body in the manner described above.

The diamond tables of PDC's, however, are susceptible to high temperatures, causing them to be more fragile and wear at higher rates as the temperature of drilling increases. In addition, these diamond tables do not provide any substantial kerfing action within the lateral extent of the path of each individual cutter during the drilling process. Kerfing is a process of making laterally-adjacent cuts, so that failure of the uncut rock between adjacent cuts affects (reduces) the overall energy required for drilling the formation. Because a single-depth diamond table has a continuous cutting edge, no kerfing action within the cutter path occurs. A so-called "claw" cutter has been developed, exhibiting a structure with parallel diamond ridges extending from the continuous major plane of the diamond table into and interleaved with the material of the supporting WC substrate. However, the kerfing action demonstrated by such cutters, as disclosed in U.S. Pat. Nos. 4,784,023 and 5,120,327, is nominal at best.

In order to manufacture diamond cutting elements of improved hardness, abrasion resistance and temperature stability, manufacturers developed a sintered PDC element from which the metallic interstitial components, typically cobalt and the like, were leached or otherwise removed to form thermally stable PDC's, or TSP's. However, due to present fabrication techniques, in order to leach the synthetic sintered PDC and achieve the desired improved temperature stability, it is necessary that these diamond elements be limited in cross sectional size. Other technologies have evolved wherein the interstitial components are replaced with silicon, but practical size limitations still exist, and the presence of silicon precludes effective metallic coating of the TSP's for non-mechanical bonding thereof to a bit body.

In order to use these TSP elements and yet achieve a larger, desired size of the cutting element, some prior art cutters incorporated an array of TSP elements disposed within a metal matrix substrate. Thus, the exposed ends of the TSP elements provided, in effect, a multi-element diamond table with a surface area substantially equal to the surface area of the ends of the TSP elements.

The prior art cutters employing a plurality of arrayed TSP elements have several disadvantages. Because these individual TSP elements replace the PDC diamond table, any substrate material between the TSP elements wears at a much higher rate than would a continuous diamond table. On the other hand, as previously mentioned, continuous PDC diamond tables are more significantly affected by heat, and may wear at an accelerated rate during the drilling process. In addition, PDC diamond tables alone do not generally provide any substantial single-cutter kerfing action. Thus, it would be advantageous to provide a cutting element for use in subterranean earth boring drill bits which provides the advantages of a continuous diamond table in combination with a plurality of additional diamond cutting structures affording additional strength and stiffness to the cutter, enhanced heat transfer away from the diamond table, and a kerfing action within the lateral bounds of a single cutter path.

SUMMARY OF THE INVENTION

In accordance with the present invention, a superabrasive cutting element is provided for use on a rotary drag bit for earth boring operations. According to the invention, a cutting element is comprised of a substrate made of a suitable material, such as cemented tungsten carbide. The substrate may be attached to a post, stud, or other carrier element which is attached by means known in the art to the face of the rotary drag bit. The carrier element orients the cutting element in an orientation relative to the instantaneous direction of linear displacement of the cutter resulting from rotation of the rotary drag bit and longitudinal movement into the formation being drilled. If no carrier element is employed, the cutting element is typically brazed into a suitably-oriented socket on the bit face.

A superabrasive table is attached to, and normally formed on, the substrate during fabrication of the cutting element, by means known in the art. The table typically comprises a polycrystalline diamond compact (PDC), although a compact of other superabrasive material such as cubic boron nitride may also be employed to define the cutting face of the cutting element. This cutting face is preferably of a generally planar configuration, but may be curved or otherwise nonlinear, but essentially planar. As used herein, the term "planar" means extending in two dimensions substantially transverse to the direction of intended travel of the cutting element, and the term "diamond" as used in the general rather than specific sense encompasses other superabrasive materials.

Because of the extreme loads and impacts associated with drilling rock formations, the diamond table is susceptible to being damaged. One way to strengthen the diamond table is to make its surface area smaller than the surface area of the supporting substrate, which may be generally cylindrical. In doing so, the substrate material may be used to buttress the edges of the diamond table and support the periphery of the diamond table against cutting-induced loads. In a preferred embodiment, a diamond table smaller than the transverse cross-section of the supporting substrate behind it and of a substantially rectangular geometry with two parallel flat sides and an arcuate top and bottom is employed. A frustoconical, forwardly-extending, inward taper of the substrate extends to and may help support the diamond table on its two arcuate sides, and a planar, forwardly-extending, inward taper extends to and may help support the diamond table on its two flat sides. These tapers provide desirable reinforcement for the diamond table during drilling operations to reduce the risk of damage to the diamond table, Further, it is preferred that the two planar tapers terminate at the diamond table in mutually parallel relationship to define a substantially constant diamond table width to engage the formation during drilling operations and as the cutting element wears. In addition, the cutting edge of the diamond table may be chamfered or rounded as known in the art to reduce the risk of the cutting edge being damaged during the initial part of the drilling operation. Normally, the cutting edge will comprise a convex edge residing at the termination of one of the frustoconical tapers at the diamond table.

Finally, a plurality of rod-like pilings made of sintered polycrystalline diamond (or other superabrasive material such as cubic boron nitride) extends rearwardly from the diamond table and is contained within the substrate. In a preferred embodiment, the diamond pilings are generally perpendicular to the diamond table and are substantially parallel to one another. The diamond pilings may be of circular, polyhedral or other cross section.

The diamond pilings may extend partially into or even through the diamond table, with the proximal ends of the diamond pilings in the latter instance being flush with the cutting face of the diamond table. Alternatively, the proximal ends of the diamond pilings may be located adjacent the rear of the diamond table, in contact therewith or slightly spaced therefrom. Further, the diamond pilings may extend into the substrate any distance less than the full length of the substrate, or may actually have their distal ends exposed at the back of the substrate.

These diamond pilings provide several enhancements to the structural integrity of the cutting element. First, they provide structural strength to the cutting element by stiffening and strengthening the diamond table in precisely the region that is contacted by the rock formation and that experiences the highest stresses.

Additionally, the pilings provide a path of low thermal resistance that will allow heat that is generated at the cutting face during the cutting process to be more efficiently carried away from the cutting edge and into the substrate. If the diamond pilings extend the full length of the substrate, they will transfer the heat directly into the drill bit body or supporting carrier element to which the substrate is mounted. Thus, the diamond table will stay cooler and, since it is well known that diamond wears more quickly at elevated temperatures, the cooler diamond table of the inventive cutting element should have a longer life than conventional cutting structures.

Moreover, the diamond pilings provide a kerfing action as the cutter wears. It is envisioned that the diamonds in the pilings will be of a harder, more abrasion resistant variety, such as finer diamond particles, than the diamond in the table, which will comprise coarser particles, providing a tougher, impact resistant surface. As the diamond table and substrate wear, the pilings will protrude from the side of the cutter along the cutting edge, creating a kerfing cutter. Kerfing has been shown to be effective in mining applications, wherein rock has been removed more efficiently than without kerfing. In the cutting element of the invention, the kerfing is accomplished by the arrangement of the diamond pilings within the cutting element. The diamond pilings in cross-section may be arranged in vertical columns as the cutter would be placed on the bit, relative to the bit face. The distance between columns of diamond pilings is preferably greater than the distance between diamond pilings of the same column. Other configurations are also possible to create this kerfing and self-sharpening effect. For example, adjacent vertical columns of diamond pilings may be offset so that pilings of every other column are in horizontal alignment. As indicated above, when the material of the diamond table and of the substrate is less abrasion resistant than that of the pilings, the diamond table and substrate wear away relatively quickly during drilling to expose a horizontal row of diamond pilings embedded in and protruding from the substrate. The lateral spacing between pilings in the row creates the potential for a kerfing action. In addition, because of the relatively close vertical proximity of each row of diamond pilings, as one row of diamond pilings wears away, a new, adjacent row is quickly exposed. Even if the pilings are less abrasion resistant than the diamond table, however, wear of the diamond table and particularly of the substrate will still expose the pilings in short order, and the relatively greater diamond volume of the pilings will still promote a kerfing action. Thus, in either instance, the cutting element has a self-sharpening effect, continually exposing fresh rows of diamond pilings.

In a preferred embodiment, the diamond pilings are contained on one side of a cutting element comprising approximately half of the cutting element closest to the cutting edge, as when half of the cutting face of the cutting element has been worn away, the cutting element would normally be replaced. Thus, there is no need to place expensive diamond pilings in a portion of the cutting element where they will not be utilized or do not significantly contribute to the strength or heat-transfer capabilities of the cutting element. Moreover, it is possible to fabricate two cutting elements from a single, substantially cylindrical part. That is, by placing the diamond pilings in both halves of a cutting element structure as initially formed and then dividing the structure longitudinally into two halves (such as by electro-discharge machining), one could simultaneously fabricate two cutting elements. A metal or other substrate shaped and sized to match the cutting element half could then, if desired, be bonded to the cutting element half to make a complete, substantially cylindrical cutting element volume.

These, and other advantages of the present invention, will become apparent from the following detailed description, the accompanying drawings, and the appended claims.

DETAILED DESCRIPTION OF THE ILLUSTRATED EMBODIMENT

Figure 1:
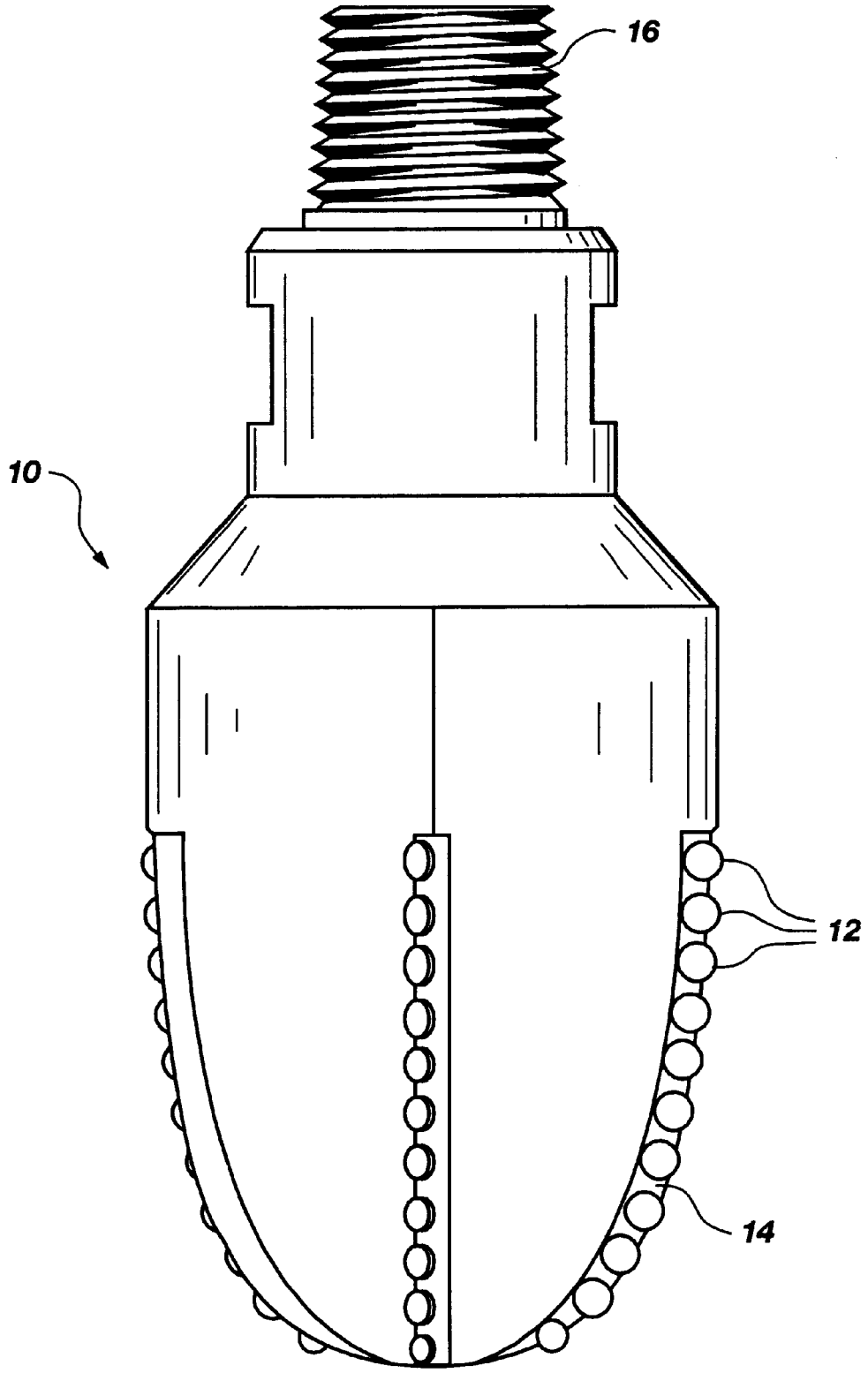
FIG. 1 is a side elevation of a rotating drag bit having cutting elements of the present invention.

The invention is illustrated in the drawings with reference to an exemplary rotary earth boring bit. Referring to FIG. 1, a drag type rotary bit 10 is shown, although the present invention is believed to possess equal utility in the context of a tri-cone or "rock" bit (not shown). The bit 10 is attached to a drill string (not shown) by external threads 16 to provide rotation of the bit 10. A plurality of cutting elements 12 of the present invention is secured to the bit face 14 of the drill bit 10 for cutting rock as the drill bit 10 is rotated within a subterranean formation.

Figure 2:
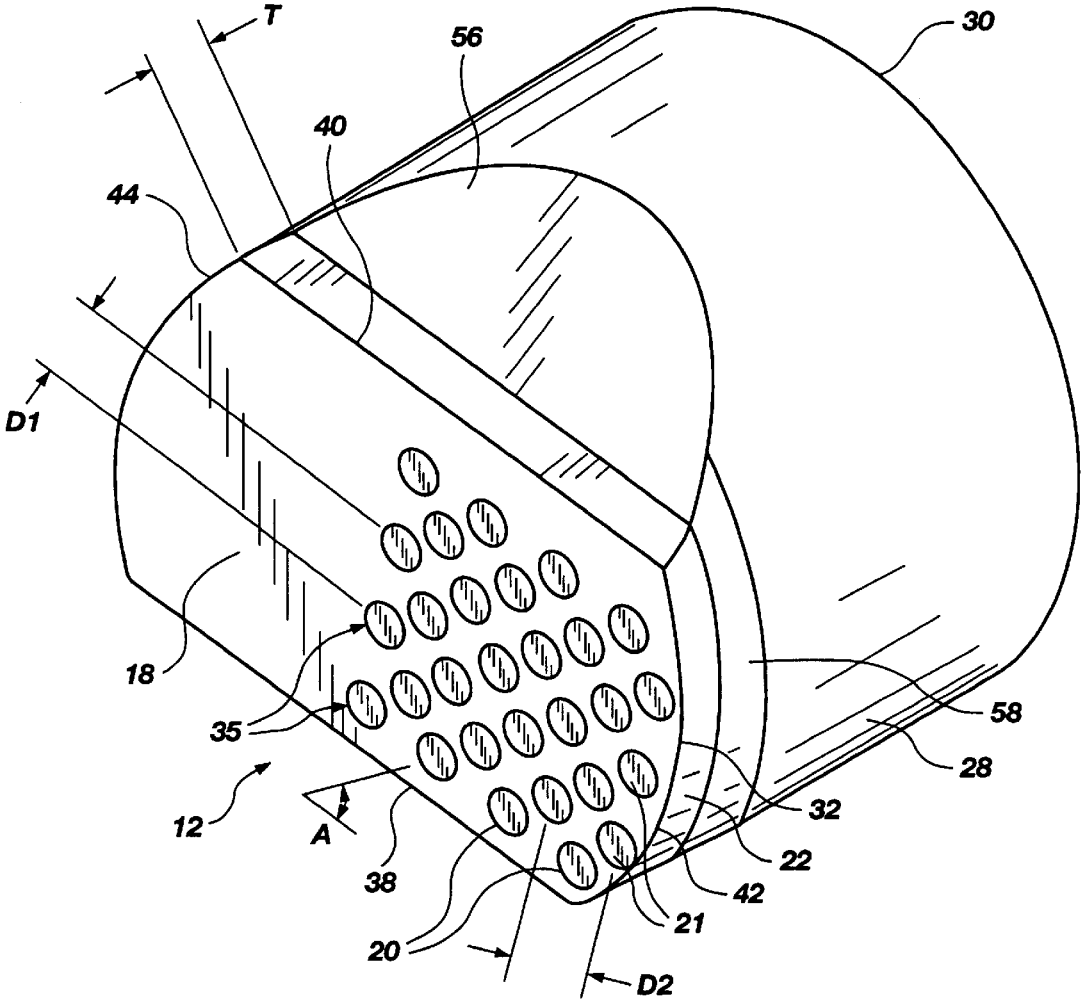
FIG. 2 is a perspective view of one embodiment of a cutting element of the present invention.

Referring now to FIG. 2, a preferred embodiment of the cutting element 12 is shown. The cutting element 12 has a cutting face 18 defined by a PDC diamond or other superabrasive table 22. The diamond table 22 has a predetermined thickness T. The diamond table 22 is attached (formed) to a substrate 28 comprised of a suitable material, typically cemented tungsten carbide. The substrate 28 has a generally circular cross section and may be attached at its distal end 30 to the bit face 14 of the drill bit 10 or to a carrier element such as a stud or cylinder, which is itself affixed to drill bit 10. The diamond table 22 has a substantially rectangular shaped cutting face 18, wherein opposing sides 38 and 40 are generally linear and opposing sides 42 and 44 are curved. Linear sides 38 and 40 are preferably positioned on the bit to achieve substantially perpendicular orientation relative to the formation so that a constant-width cutting edge 32 is presented to the formation.

A plurality of superabrasive pilings 20 comprising sintered polycrystalline diamond rod-like elements is disposed within the substrate 28 and extends through the cutting face 18 of the diamond table 22. Other suitable superabrasive materials such as cubic boron nitride may also be employed in the pilings. A plurality of diamond piling ends 21 is flush with the planar cutting face 18 of the cutting element 12. In this embodiment, the diamond pilings 20 are arranged in a plurality of staggered or vertically-offset columns 35, the pilings 20 being aligned at substantially perpendicular angle A with respect to the cutting face 18. The diamond pilings 20 are further arranged so that the distance D1 between vertical columns 35 of horizontally-aligned pilings 20 (as the cutting element is oriented on the bit face), the pilings of which will simultaneously engage the formation, is greater than the distance D2 between adjacent diamond pilings 20 of the same vertical column 35. Stated another way, as shown in FIG. 2, the pilings of every other vertical column are arrayed in horizontal rows and so will engage the formation simultaneously. When a particular row of pilings is completely worn, the next-higher piling row of the alternate, staggered columns will next engage the formation.

Preferably, the material of the diamond table 22 is coarser and tougher, but less abrasion resistant, than the material of the diamond pilings 20. This contrast in material wear characteristics allows the diamond table 22 to wear relatively more rapidly than the diamond pilings 20, quickly exposing the diamond pilings 20 to the rock formation being drilled. This feature, along with the distances D1 between exposed diamond pilings 20 of adjacent columns, creates a kerfing structure that more efficiently removes the rock formation during the drilling process. Moreover, because of the relatively small distance D2 between diamond pilings 20 of the same column, as a row of laterally-spaced exposed diamond pilings 20 wears, a new row of diamond pilings 20 is exposed to the rock formation, thus creating a self sharpening effect.

As shown, diamond pilings 20 are substantially round or circular in transverse cross-section, although rectangular, triangular or other polyhedral cross-sections may be employed, as may cross-sections including combined arcuate and linear boundaries such as half-circles, or triangles with one curved side. While a symmetrical crosssection is currently preferred for uniformity of stress distribution in the cutting structure, it is contemplated that a symmetrical cross-section may be employed with utility.

Further, the diamond pilings 20 in a preferred embodiment are arranged in approximately one lateral half of the cutting element 12. That is, the diamond pilings 20 are preferably arranged primarily in the portion of the cutting element 12 that is closest to the cutting edge 32 of the diamond table 22, as cutting element 12 is oriented on the face of bit 10.

Figure 3:
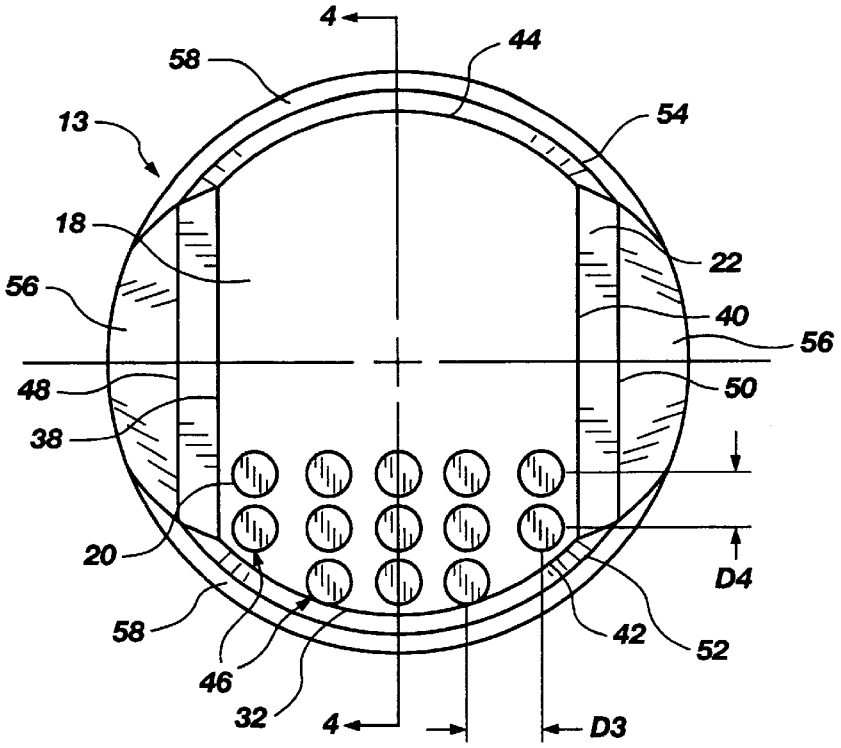
FIG. 3 is a front elevation of another embodiment of a cutting element of the present invention.
Figure 4:
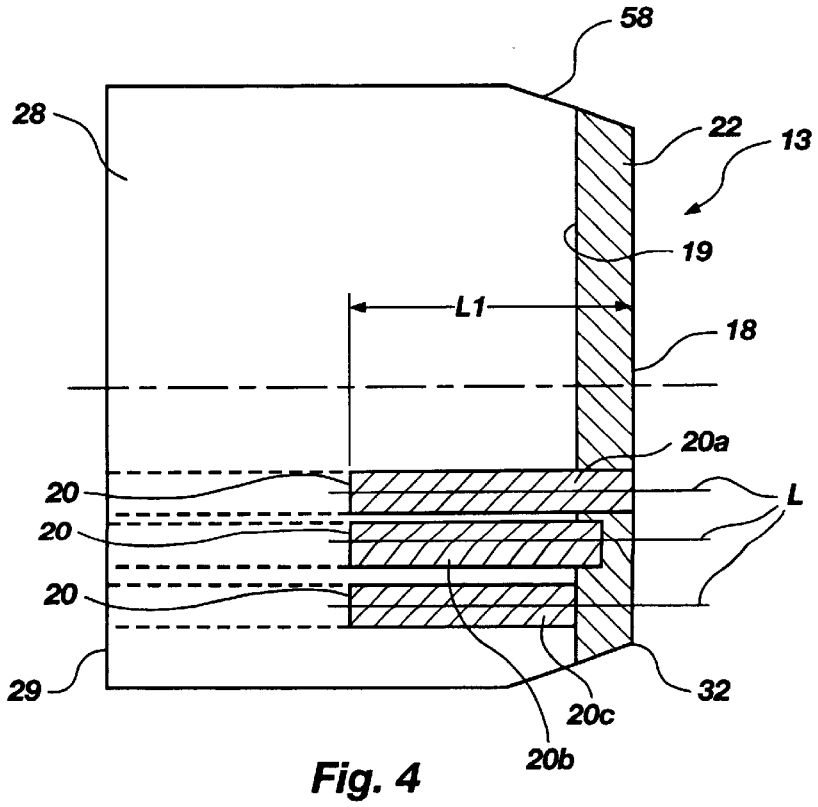
FIG. 4 is a cross sectional view of the embodiment of FIG. 3 taken along line 4—4.

Referring now to FIG. 3 and FIG. 4, another preferred embodiment of the present invention is shown. The cutting element 13 is substantially the same as the cutting element 12 shown in FIG. 2 except that the arrangement of diamond pilings 20 is different. While the pilings 20 in the cutting element 12 are vertically staggered in adjacent columns, the pilings of each column in cutter 13 are horizontally aligned with those of the adjacent column or columns. As shown in FIG. 3, the diamond pilings 20 are arranged in a plurality of columns 46. Similar to the arrangement in FIG. 2, the distance D3 between the pilings simultaneously engaging the formation among the plurality of columns 46 is greater than the distance D4 between diamond pilings 20 of the same column. As described with reference to FIG. 2, the distances D3 generate the desired kerfing action, while the distance D4 provides the self sharpening effect by immediately replacing worn-through pilings with new ones. In the embodiment of FIG. 3, unlike that of FIG. 2, the kerfing action will be conducted along the same horizontally-spaced locations throughout the total wear life of the cutting element.

As seen in FIG. 4, the diamond pilings 20 of cutting element 13 extend a length L1 into the substrate 28. Further, each diamond piling 20 has a longitudinal axis L, the longitudinal axes L of the diamond pilings 20 lying substantially parallel to one another. Further, the diamond pilings 20 are contained in the portion of the cutting element 13 closest to the cutting edge 32. Once the cutting element 13 wears to a point where approximately half of the cutting face 18 has been worn away, along with a substantial portion of the diamond pilings 20, the cutting element 13 is normally replaced. Thus, by limiting the number and the length L1 of the diamond pilings 20, a reduced amount of the material comprising the diamond pilings 20 is employed.

Referring again to FIG. 4, it will be noted that the proximal ends of diamond pilings 20 may assume several different locations relative to diamond table 22. For example, piling 20*a* extends completely through table 22 and terminates co-planarly with cutting face 18. Piling 20*b* extends into diamond table 22, but terminates short of the cutting face 18. Piling 20*c* terminates in abutment with the trailing face 19 of diamond table 22 in abutment thereto. While it is also possible to fabricate a substrate whollyencompassing diamond pilings 20 in spaced relationship from the trailing face 19 of diamond table 22 (i.e., out of contact with diamond table 22 and with substrate material between the back of the diamond table and the front of the pilings), such a design is less preferred as providing inferior heat transfer, lower stiffness adjacent the diamond table 22, and possibly initiating spalling and fracture of the diamond table 22 due to wear of substrate material between the proximal ends of the pilings 20 and the trailing face 19 of the diamond table 22.

The diamond pilings 20 also help strengthen (stiffen) the diamond table 22 in the area closest to the cutting edge 32 where the greatest forces and impacts are experienced. In addition, to cool the heat-susceptible diamond table and transfer the frictionally-generated heat developed at the cutting edge and on the cutting face during drilling of rock formations, the diamond pilings 20 direct heat away from the diamond table 22, into the substrate 28 and ultimately into the bit face 14 of the drill bit 10. As shown in broken lines in FIG. 4, pilings 20 may extend completely through substrate 28 to the rear 29 thereof, promoting more efficient heat transfer from the diamond table 22 to a carrier structure or the drill bit body.

As best seen in FIG. 2, FIG. 3, and FIG. 4, side surfaces 48, 50, 52, and 54 are tapered to provide additional support and protection for the diamond table 22 against loads generated by contact with the rock formation during drilling. Surfaces 48 and 50 of substrate 28, associated with sides 38 and 40 of diamond table 22, respectively, have a planar inward taper 56 that extends from the cylindrical periphery of the substrate 28 through the diamond table 22 along the side edges 38 and 40 to cutting face 18 of diamond table 22. Likewise, surfaces 52 and 54, associated with arcuate sides 42 and 44 of diamond table 22, respectively, have a frusto-conical inward taper 58 that extends from the periphery of the substrate 28 through the diamond table 22 along the sides 42 and 44 of diamond table 22 to cutting face 18.

Figure 5:
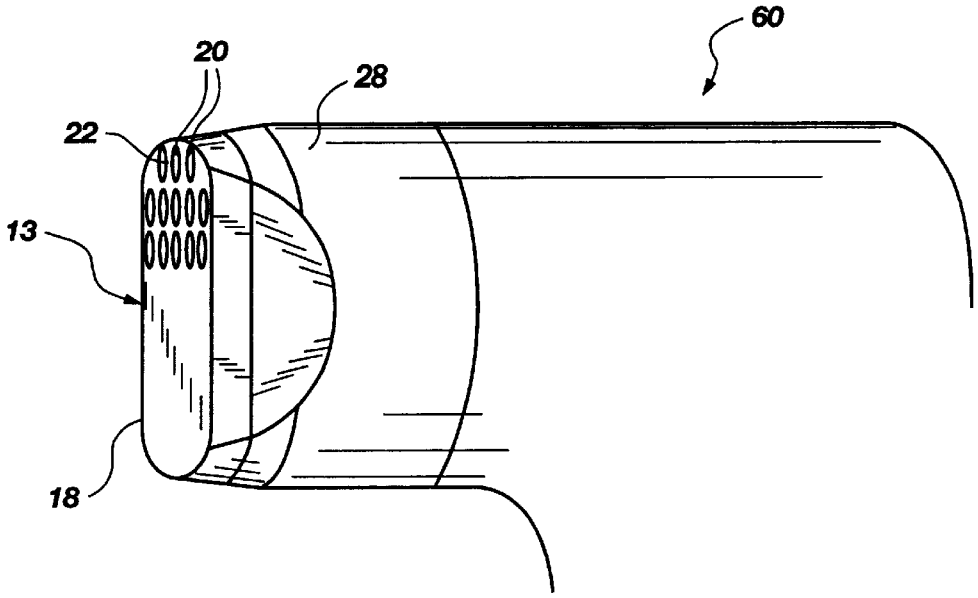
FIG. 5 is a perspective view of a stud-type cutting structure employing the cutting element shown in FIG. 3.
Figure 6:
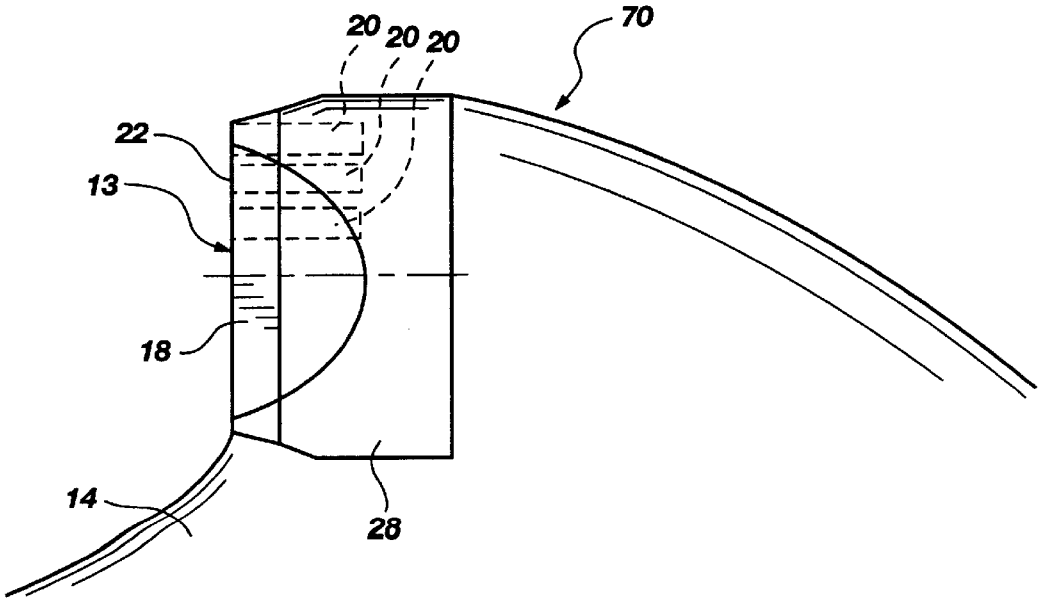
FIG. 6 is a side view of an infiltrated or matrix-type bit body carrying the cutting element shown in FIG. 3, brazed into a socket in the bit face.

As shown in FIG. 5 and FIG. 6, the cutting elements 12 and 13 may be attached to various types of carrier elements or support structures 60 and 70. FIG. 5 shows a stud cutter 60 with cutting element 13 attached thereto. The cutting element 13 is oriented so that the diamond pilings 30 are positioned farthest away from the bit face and closest to the rock formation to be cut. FIG. 6 shows an infiltrated-matrix cutting tooth or blade 70 with cutting element 13 attached thereto as by brazing. In a similar fashion, the diamond pilings 20 are positioned to be nearest to the rock formation to be cut.

While certain representative embodiments and details have been shown for purposes of illustrating the invention, it will be apparent to those skilled in the art that various changes in the invention disclosed herein may be made without departing from the scope of the invention, which is defined in the appended claims. For example, various arrangements of the diamond pilings may be used, as well as various cross sectional shapes of the diamond pilings themselves; various shapes and sizes of substrates and diamond tables may be utilized; and the angles and contours of any beveled or tapered surfaces may vary.

What is claimed is:

1. A cutter for use on a rotary drag bit for earth boring, comprising:

a substrate having a front and a rear, taken in a direction of intended cutter movement;

a superabrasive table of a first material carried on said front of said substrate and defining a substantially planar cutting face having a cutting edge and having a trailing face; and a plurality of superabrasive pilings of a second material exhibiting at least a different abrasion-resistance than said first material, each superabrasive piling having a longitudinal axis, a distal and a proximal end, disposed in said substrate, said distal ends of said superabrasive pilings extending away from said superabrasive table into said substrate and at least one of said plurality of superabrasive pilings extending to the rear of said substrate, said superabrasive pilings lying in substantially perpendicular arrangement to an orientation of said substantially planar cutting face.

2. A cutter for use on a rotary drag bit for earth boring, comprising:

a substrate having a front and a rear, taken in a direction of intended cutter movement;

a superabrasive table carried on said front of said substrate and defining a substantially planar cutting face having a cutting edge; and a plurality of superabrasive pilings, each superabrasive piling having a longitudinal axis, a distal and a proximal end, disposed in said substrate, said distal ends of said superabrasive pilings extending away from said superabrasive table into said substrate, said superabrasive pilings lying in substantially perpendicular arrangement to an orientation of said substantially planar cutting face;

wherein said superabrasive table comprises a layer of material tougher and less abrasion resistant than a material of said superabrasive pilings.

3. The cutter of claim 2, wherein said proximal end of at least one of said plurality of superabrasive pilings terminates at said cutting face.

4. The cutter of claim 2, wherein said plurality of superabrasive pilings is arranged in vertical columns substantially transverse to said cutting edge of said cutting face.

5. The cutter of claim 4, wherein said plurality of superabrasive pilings is oriented with its longitudinal axes in a mutually parallel relationship.

6. The cutter of claim 5, wherein a distance between said longitudinal axes of said plurality of superabrasive pilings in adjacent columns of said plurality of superabrasive pilings is more than a distance between said longitudinal axes of said plurality of superabrasive pilings of a same column.

7. The cutter of claim 5, wherein a distance between said longitudinal axes of said plurality of superabrasive pilings in alternate columns of said plurality of superabrasive pilings is more than a distance between said longitudinal axes of said plurality of superabrasive pilings of a same column.

8. The cutter of claim 5, wherein superabrasive pilings of adjacent columns are horizontally aligned.

9. The cutter of claim 5, wherein superabrasive pilings of adjacent columns are vertically offset such that superabrasive pilings of every other column are in horizontal alignment.

10. The cutter of claim 2, wherein said plurality of superabrasive pilings is contained in half of said cutter closest to said cutting edge.

11. The cutter of claim 2, wherein at least one of said plurality of superabrasive pilings extends to the rear of said substrate.

12. The cutter of claim 2, wherein said distal end of at least one of said plurality of superabrasive pilings terminates near a distal end of said substrate.

13. The cutter of claim 2, wherein each of said plurality of superabrasive pilings comprises a rod-like polycrystalline superabrasive element.

14. The cutter of claim 2, wherein said cutting face is substantially rectangular in shape.

15. The cutter of claim 2, wherein said substrate has a frustoconical inward taper over at least a portion of its periphery extending proximally to said superabrasive table.

16. The cutter of claim 2, wherein said substrate has a planar inward taper over at least a portion of its periphery extending proximally to said superabrasive table.

17. The cutter of claim 2, wherein said proximal end of at least one of said plurality of superabrasive pilings terminates within said superabrasive table.

18. The cutter of claim 2, wherein said proximal end of at least one of said plurality of superabrasive pilings terminates at said trailing face of said superabrasive table and in contact therewith.

19. A cutter for use on a rotary bit for earth boring, comprising:

a substrate having a front and a rear, taken in a direction of intended cutter movement;

a superabrasive table carried on said front or said substrate and defining a substantially planar cutting face having a cutting edge and having a trailing face; and a plurality of superabrasive pilings, each superabrasive piling having a longitudinal axis, a distal end and a proximal end, disposed in said substrate, said distal ends of said superabrasive pilings extending away from said superabrasive table into said substrate, a proximal end of at least one of said plurality of superabrasive pilings terminating at said trailing face of said superabrasive table and in contact therewith, said superabrasive pilings lying in substantially perpendicular arrangement to an orientation of said substantially planar superabrasive cutting face.

20. The cutter of claim 19, wherein said superabrasive table comprises a layer of material tougher and less abrasion resistant than a mateial of said superabrasive pilings.

21. A rotary drag bit for subterranean earth boring operations comprising:

a drill bit body having an outer surface; and at least one cutting element attached to said outer surface and comprising a plurality of rod-like superabrasive elements each having a longitudinal axis, a substrate having a front end and a rear end taken in a direction of intended bit rotation, and disposed between and around each of said plurality of superabrasive elements, and a superabrasive table carried on said substrate front end having a trailing face and defining a cutting face and a cutting edge of said at least one cutting element, each of said plurality of superabrasive elements extending from said superabrasive table into said substrate;

wherein at least one of said plurality of rod-like superabrasive elements extends to the rear of said substrate; and wherein said rod-like superabrasive elements are formed of a material exhibiting at least a different abrasion-resistance than a material of which said superabrasive table is formed.

22. A rotary drag bit for subterranean earth boring operations comprising:

a drill bit body having an outer surface; and at least one cutting element attached to said outer surface and comprising a plurality of rod-like superabrasive elements each having a longitudinal axis, a substrate having a front end and a rear end taken in a direction of intended bit rotation and disposed between and around each of said plurality of rod-like superabrasive elements, and a superabrasive table carried on said substrate front end defining a cutting face and a cutting edge of said at least one cutting element, each of said plurality of rod-like superabrasive elements extending from said superabrasive table into said substrate;

wherein said superabrasive table comprises a material tougher and less abrasion resistant than a material of said plurality of rod-like superabrasive elements.

23. The rotary drag bit of claim 22, wherein said cutting face is substantially rectangular in shape.

24. The rotary drag bit of claim 23, wherein said substrate has a substantially cylindrical distal portion and a proximal portion extending to said superabrasive table including an inwardly-tapering frustoconical peripheral segment flanked by first and second substantially parallel inwardly tapering planar peripheral segments.

25. The rotary drag bit of claim 22, wherein an end of at least one of said plurality of rod-like superabrasive elements terminates at said cutting face of said superabrasive table.

26. The rotary drag bit of claim 22, wherein said plurality of rod-like superabrasive elements is arranged in a plurality of vertical columns substantially transverse to said cutting edge.

27. The rotary drag bit of claim 26, wherein said plurality of rod-like superabrasive elements is oriented with its longitudinal axes in a mutually parallel relationship.

28. The rotary drag bit of claim 26, wherein rod-like superabrasive elements of adjacent columns are vertically offset such that superabrasive elements of every other column are in horizontal alignment.

29. The rotary drag bit of claim 27, wherein a distance between said longitudinal axes of said plurality of superabrasive elements in adjacent columns of said plurality of superabrasive elements is more than a distance between said longitudinal axes of said superabrasive elements of a same column.

30. The rotary drag bit of claim 27, wherein a distance between said longitudinal axes of said plurality of superabrasive elements in alternate columns of said plurality of superabrasive elements is more than a distance between said longitudinal axes of said plurality of superabrasive elements of a same column.

31. The rotary drag bit of claim 27, wherein rod-like superabrasive elements of adjacent columns are horizontally aligned.

32. The rotary drag bit of claim 27, wherein rod-like superabrasive elements of adjacent columns are vertically offset such that superabrasive elements of every other column are in horizontal alignment.

33. The rotary drag bit of claim 26, wherein said columns of said rod-like superabrasive elements are contained in half of said at least one cutting element closest to said cutting edge.

34. The rotary drag bit of claim 22, wherein at least one of said plurality of rod-like superabrasive elements extends to the rear of said substrate.

35. The rotary drag bit of claim 22, wherein at least one of said plurality of rod-like superabrasive elements extends to a location near a distal end of said substrate.

36. The rotary drag bit of claim 22, wherein an end of at least one of said plurality of rod-like superabrasive elements terminates within said superabrasive table.

37. The rotary drag bit of claim 22, wherein an end of at least one of said plurality of rod-like superabrasive elements terminates adjacent and in contact with said superabrasive table.

38. The rotary drag bit of claim 22, wherein said substrate has a frustoconical inward taper over at least a portion of its periphery extending proximally to said stuperabrasive table.

39. The rotary drag bit of claim 22, wherein said substrate has a planar inward taper over at least a portion of its periphery extending proximally to said superabrasive table.

40. The rotary drag bit of claim 22, wherein an end of at least one of said plurality of rod-like superabrasive elements terminates at said trailing face of said superabrasive table and in contact therewith.

41. A rotary drag bit for subterranean earth boring operations, comprising:

a drill bit body having an outer surface; and at least one cutting element attached to said outer surface and comprising a plurality of rod-like superabrasive elements each having a longitudinal axis, a substrate having a front end and a rear end taken in a direction of intended bit rotation and disposed between and around each of said plurality of rod-like superabrasive elements, and a superabrasive table carried on said substrate front end having a trailing face and defining a cutting face and a cutting edge of said at least one cutting element, each of said plurality of rod-like superabrasive elements extending from said superabrasive table into said substrate;

wherein an end of at least one of said plurality of rod-like superabrasive elements terminates at said trailing face of said superabrasive table and in contact therewith.

42. The rotary drag bit of claim 41, wherein said superabrasive table comprises a layer of material tougher and less abrasion resistant than a material of said plurality of rod-like superabrasive elements.

43. A cutter for use on a rotary drag bit for earth boring, comprising:

a substrate having a front and a rear, taken in a direction of intended cutter movement;

a superabrasive table carried on said front of said substrate and defining a substantially planar cutting face having a cutting edge; and a plurality of superabrasive pilings, each superabrasive piling having a longitudinal axis, a distal and a proximal end, disposed in said substrate, said distal ends of said superabrasive pilings extending away from said superabrasive table into said substrate, a proximal end of at least one of said plurality of superabrasive pilings terminating at said cutting face, said superabrasive pilings lying in substantially perpendicular arrangement to an orientation of said substantially planar cutting face.

44. A cutter for use on a rotary drag bit for earth boring, comprising:

a substrate having a front and a rear, taken in a direction of intended cutter movement;

a superabrasive table carried on said front of said substrate and defining a substantially planar cutting face having a cutting edge; and a plurality of superabrasive pilings, each superabrasive piling having a longitudinal axis, a distal and a proximal end, disposed in said substrate, said distal ends of said superabrasive pilings extending away from said superabrasive table into said substrate, a proximal end of at least one of said plurality of superabrasive pilings terminating within said superabrasive table, said superabrasive pilings lying in substantially perpendicular arrangement to an orientation of said substantially planar cutting face.

45. A rotary drag bit for subterranean earth boring operations, comprising:

a drill bit body having an outer surface; and at least one cutting element attached to said outer surface and comprising a plurality of rod-like superabrasive elements each having a longitudinal axis, a substrate having a front end and a rear end taken in a direction of intended bit rotation and disposed between and around each of said plurality of rod-like superabrasive elements, and a superabrasive table carried on said substrate front end defining a cutting face and a cutting edge of said at least one cutting element, each of said plurality of rod-like superabrasive elements extending from said superabrasive table into said substrate;

wherein an end of at least one of said plurality of rod-like superabrasive elements terminates at said cutting face of said superabrasive table.

46. A rotary drag bit for subterranean earth boring operations comprising:

a drill bit body having an outer surface; and at least one cutting element attached to said outer surface and comprising a plurality of rod-like superabrasive elements each having a longitudinal axis, a substrate having a front end and a rear end taken in a direction of intended bit rotation and disposed between and around each of said plurality of rod-like superabrasive elements, and a superabrasive table carried on said substrate front end defining a cutting face and a cutting edge of said at least one cutting element, each of said plurality of rod-like superabrasive elements extending from said superabrasive table into said substrate;

wherein an end of at least one of said plurality of rod-like superabrasive elements terminates within said superabrasive table.

47. A cutter for use on a rotary drag bit for earth boring, comprising:

a substrate having a front and a rear, taken in a direction of intended cutter movement, a substantially cylindrical distal portion proximate said rear and a proximal portion extending to said front and including an inwardly-tapering frustoconical peripheral segment flanked by first and second substantially parallel inwardly-tapering planar peripheral segments;

a substantially rectangular superabrasive table carried on said front of said substrate and defining a substantially planar cutting face having a cutting edge and having a trailing face; and a plurality of superabrasive pilings, each having a longitudinal axis, disposed in said substrate, distal ends of said superabrasive pilings extending away from said superabrasive table into said substrate.

48. A rotary drag bit for subterranean earth boring operations comprising:

a drill bit body having an outer surface; and at least one cutting element attached to said outer surface and comprising:

a plurality of rod-like superabrasive elements each having a longitudinal axis;

a substrate having a front end and a rear end taken in a direction of intended bit rotation, a substantially cylindrical distal portion proximate said rear end and a proximal portion extending to said front end and including an inwardly-tapering frustoconical peripheral segment flanked by first and second substantially parallel inwardly-tapering planar peripheral segments; said substrate being disposed between and around each of said plurality of superabrasive elements; and a superabrasive table carried on said substrate front end and defining a cutting face and a cutting edge of said at least one cutting element, each of said plurality of superabrasive elements extending from said superabrasive table into said substrate.

49. A rotary drag bit for subterranean earth boring operations comprising:

a drill bit body having an outer surface; and at least one cutting element attached to said outer surface and comprising a plurality of rod-like superabrasive elements each having a longitudinal axis, a substrate having a front end and a rear end taken in a direction of intended bit rotation and disposed between and around each of said plurality of rod-like superabrasive elements, and a superabrasive table carried on said substrate front end, having a trailing face and defining a cutting face and a cutting edge of said at least one cutting element, each of said plurality of rod-like superabrasive elements extending from said superabrasive table into said substrate;

wherein said superabrasive elements are formed of a material exhibiting at least a different abrasion-resistance than a material of which said superabrasive table is formed; and wherein at least one of said plurality of rod-like superabrasive elements extends to a location near a distal end of said substrate.

* * * * *

UNITED STATES PATENT AND TRADEMARK OFFICE

CERTIFICATE OF CORRECTION

PATENT NO. : 6,009,963
DATED : January 4, 2000
INVENTOR(S) : Chaves et al.

It is certified that error appears in the above-identified patent and that said Letters Patent is hereby corrected as shown below:

Title page,
Line 3, "Foreign Patent Documents", add -- A -- to end of number to read -- 2 044 146A --; and
Under "Other Publications" add -- International Search Report dated October 22, 1998 --.

Column 5,
Line 13, after "drag type rotary" insert -- drill --;
Line 15, after "The" insert -- drill --;
Line 17, after "the" insert -- drill --;
Line 38, after "superabrasive" insert -- diamond --;
Line 47, before "pilings" insert -- diamond --;
Line 50, after "horizontally-aligned" insert -- diamond --;

Column 6,
Lines 6 and 7, change "self sharpening" to -- self-sharpening --;
Line 13, change "crosssection" to -- cross-section --;
Line 23, after "of" insert -- drill --;
Line 28, after "the" (first occurrence) insert -- diamond --;
Line 30, delete "cutter" and insert -- cutting element -- therefor;
Line 61, after "through" insert -- diamond --;

Column 7,
Line 20, after "FIG. 4," insert -- diamond --;
Line 38, change "cutting elements 12" to -- cutting element 13 --;
Line 39, delete "and 13" at the beginning of the line;
Line 42, change "30" to -- 20 --;

Column 8, claim 1,
Line 4, delete "a" and insert -- one -- therefor;
Line 6, after "distal" insert -- end --;

Column 8, claim 2,
Line 22, after "distal" insert -- end --;

Column 9, claim 18,
Line 14, delete "said" (first occurrence) and insert -- a -- therefor;

UNITED STATES PATENT AND TRADEMARK OFFICE

CERTIFICATE OF CORRECTION

PATENT NO. : 6,009,963
DATED : January 4, 2000
INVENTOR(S) : Chaves et al.

It is certified that error appears in the above-identified patent and that said Letters Patent is hereby corrected as shown below:

Column 9, claim 19,
Line 20, change "or" to -- of --;
Line 27, delete "a" and insert -- said -- therefor;
Line 33, delete "superabrasive";

Column 9, claim 21,
Line 38, after "operations" insert -- , --;
Line 45, after "of" (second occurrence) insert -- rod-like --;
Line 49, after "of" (second occurrence) insert -- rod-like --;
Line 52, after "rear" insert -- end --;

Column 9, claim 22,
Line 59, after "operations" insert -- , --;

Column 10, claim 24,
Line 14, after "inwardly-tapering" insert -- , --;
Line 15, after "parallel" insert -- , -- and after "tapering" insert -- , --;

Column 10, claim 29,
Line 35, after "said" insert -- plurality of --;

Column 10, claim 33,
Line 50, after "said" insert -- plurality of --;
Line 51, change "are" to -- is --;
Line 52, delete "said" (first occurrence);

Column 10, claim 34,
Line 56, after "rear" insert -- end --;

Column 10, claim 38,
Line 69, change "stuperabrasive" to -- superabrasive --;

Column 11, claim 40,
Line 6, delete "said" (first occurrence) and insert -- a -- therefor;

Column 12, claim 47,
Line 38, after "tapering" insert -- , --;
Line 39, after "parallel" insert -- , --;
Line 39, after "inwardly-tapering" insert -- , --;

UNITED STATES PATENT AND TRADEMARK OFFICE

CERTIFICATE OF CORRECTION

PATENT NO. : 6,009,963
DATED : January 4, 2000
INVENTOR(S) : Chaves et al.

It is certified that error appears in the above-identified patent and that said Letters Patent is hereby corrected as shown below:

Column 12, claim 48,
Line 50, after "tions" insert -- , --;
Line 60, after "inwardly-tapering" insert -- , --;
Line 62, after "parallel" insert -- , --;
Line 62, after "inwardly-tapering" insert -- , --;
Line 64, after "of" (second occurrence) insert -- rod-like --;

Column 13, claim 48,
Line 1, after "of" (second occurrence) insert -- rod-like --;

Column 13, claim 49,
Line 5, after "operations" insert -- , --; and

Column 14, claim 49,
Line 5, after "said" insert -- rod-like --.

Signed and Sealed this

Ninth Day of October, 2001

*Attest:*

Nicholas P. Godici

*Attesting Officer*

NICHOLAS P. GODICI
*Acting Director of the United States Patent and Trademark Office*